US010253981B2

(12) United States Patent
Kowald et al.

(10) Patent No.: US 10,253,981 B2
(45) **Date of Patent: *Apr. 9, 2019**

(54) FURNACE, A METHOD FOR OPERATING A FURNACE AND A FURNACE CONTROLLER CONFIGURED FOR THE SAME

(71) Applicant: Lennox Industries Inc., Richardson, TX (US)

(72) Inventors: Glenn W. Kowald, Carrollton, TX (US); Darcy Q. Easterling, Flower Mound, TX (US)

(73) Assignee: Lennox Industries Inc., Richardson, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/684,133

(22) Filed: Aug. 23, 2017

(65) Prior Publication Data

US 2017/0350595 A1 Dec. 7, 2017

Related U.S. Application Data

(63) Continuation of application No. 15/091,956, filed on Apr. 6, 2016, now Pat. No. 9,765,965, which is a (Continued)

(51) Int. Cl.
*F24H 3/00* (2006.01)
*F23N 5/20* (2006.01)

(Continued)

(52) U.S. Cl.
CPC ..... *F23N 5/203* (2013.01); *F23N 3/082* (2013.01); *F23N 5/242* (2013.01); *F23N 5/245* (2013.01);

(Continued)

(58) Field of Classification Search
CPC ..... F23N 3/082; F23N 5/203; F23N 5/242; F23N 2037/10; F23N 2031/12; F23N 2033/04; F23N 2027/02

(Continued)

(56) References Cited

U.S. PATENT DOCUMENTS 2,079,807 A 5/1937 Kehl
2,631,659 A 3/1953 Wright (Continued)

FOREIGN PATENT DOCUMENTS

CN 1729371 A 2/2006
CN 1849495 A 10/2006

(Continued)

OTHER PUBLICATIONS

Translation of Chinese office action dated Jul. 7, 2014, Applicant: Lennox Industries Inc., 7 pages.

(Continued)

*Primary Examiner* — Kenneth Rinehart
*Assistant Examiner* — Bao D Nguyen
(74) *Attorney, Agent, or Firm* — Winstead PC

(57) ABSTRACT

A controller for a gas furnace, a computer-usable medium for implementing a method and a gas furnace are disclosed herein. In one embodiment, the controller includes: (1) an interface configured to receive a heating call and (2) a processor configured to enable an inducer of the gas furnace at a low speed based on the heating call and ignite the gas furnace at a high fire operation when determining a low fire pressure switch of the gas furnace is open.

20 Claims, 2 Drawing Sheets

Related U.S. Application Data continuation of application No. 12/834,478, filed on Jul. 12, 2010, now Pat. No. 9,335,045.

(60) Provisional application No. 61/295,501, filed on Jan. 15, 2010.

(51) Int. Cl.
*F23N 3/08* (2006.01)
*F23N 5/24* (2006.01)
*F24H 3/02* (2006.01)

(52) U.S. Cl.
CPC ..... *F24H 3/02* (2013.01); *F23N 2027/02* (2013.01); *F23N 2031/12* (2013.01); *F23N 2033/04* (2013.01); *F23N 2037/10* (2013.01)

(58) Field of Classification Search
USPC ..... 126/99 R, 110 R, 116 A, 116 E, 116 R; 431/12, 19, 20, 75, 76; 236/1 G
See application file for complete search history.

(56) References Cited

U.S. PATENT DOCUMENTS

| | | | | |
|---|---|---|---|---|
| 3,274,990 | A | 9/1966 | MacCracken | |
| 3,806,038 | A | 4/1974 | Nelson | |
| 4,309,947 | A | 1/1982 | Ketterer | |
| 4,309,977 | A | 1/1982 | Kitchen | |
| 4,481,935 | A | 11/1984 | Bawel | |
| 4,603,680 | A | 8/1986 | Dempsey et al. | |
| 4,622,947 | A | 11/1986 | Hays et al. | |
| 4,638,942 | A | 1/1987 | Ballard et al. | |
| 4,682,579 | A | 7/1987 | Bigham | |
| 4,729,328 | A | 3/1988 | Shellenberger | |
| 4,887,767 | A | 12/1989 | Thompson et al. | |
| 4,976,459 | A | 12/1990 | Lynch | |
| 4,982,721 | A | 1/1991 | Lynch | |
| 5,027,789 | A | 7/1991 | Lynch | |
| 5,123,452 | A | 6/1992 | LeBlanc | |
| 5,186,386 | A * | 2/1993 | Lynch | F23N 5/203 236/11 |
| 5,197,664 | A | 3/1993 | Lynch | |
| 5,313,930 | A | 5/1994 | Kujawa et al. | |
| 5,320,087 | A | 6/1994 | Froman | |
| 5,322,050 | A | 6/1994 | Lu | |
| 5,347,980 | A | 9/1994 | Shellenberger | |
| 5,375,586 | A | 12/1994 | Schumacher et al. | |
| 5,429,150 | A | 7/1995 | Siefers, Jr. | |
| 5,448,986 | A | 9/1995 | Christopher et al. | |
| 5,522,541 | A | 6/1996 | Zia et al. | |
| 5,582,159 | A | 12/1996 | Harvey et al. | |
| 5,623,918 | A | 4/1997 | Swilik, Jr. et al. | |
| 5,642,660 | A | 7/1997 | Killgore et al. | |
| 5,666,889 | A | 9/1997 | Evens et al. | |
| 5,704,343 | A | 1/1998 | Ahn et al. | |
| 5,749,355 | A | 5/1998 | Roan et al. | |
| 5,775,318 | A | 7/1998 | Haydock et al. | |
| 5,799,646 | A | 9/1998 | Zia et al. | |
| 6,237,545 | B1 | 5/2001 | Barnett et al. | |
| 6,321,744 | B1 | 11/2001 | Dempsey et al. | |
| 6,893,252 | B2 | 5/2005 | Stephens et al. | |
| 7,036,498 | B2 | 5/2006 | Riepenhoff et al. | |
| 8,056,533 | B2 | 11/2011 | Wagner | |
| 8,056,553 | B2 | 11/2011 | Khan | |
| 8,393,318 | B2 | 3/2013 | Khan et al. | |
| 8,474,281 | B2 | 7/2013 | Kumar | |
| 8,561,601 | B2 | 10/2013 | Schneberger et al. | |
| 8,672,673 | B2 | 3/2014 | Noman et al. | |
| 8,683,993 | B2 | 4/2014 | Paller et al. | |
| 9,335,045 | B2 * | 5/2016 | Kowald | F23N 3/082 |
| 9,765,965 | B2 * | 9/2017 | Kowald | F23N 5/203 |
| 2003/0188733 | A1 | 10/2003 | Woodall et al. | |
| 2005/0126558 | A1 | 6/2005 | Riepenhoff et al. | |
| 2007/0003891 | A1 | 1/2007 | Jaeschke | |
| 2008/0314375 | A1 | 12/2008 | Khan | |
| 2009/0044793 | A1 | 2/2009 | Khan et al. | |
| 2009/0044794 | A1 * | 2/2009 | Hugghins | F23N 3/002 126/116 A |
| 2011/0070818 | A1 | 3/2011 | Goel et al. | |
| 2011/0174201 | A1 | 7/2011 | Kowald et al. | |
| 2011/0174291 | A1 | 7/2011 | Manohar et al. | |
| 2011/0174461 | A1 | 7/2011 | Kowald et al. | |
| 2011/0174471 | A1 | 7/2011 | Paller et al. | |
| 2011/0174891 | A1 | 7/2011 | Kowald et al. | |
| 2011/0177465 | A1 | 7/2011 | Paller et al. | |
| 2012/0055465 | A1 | 3/2012 | Khan | |
| 2012/0090591 | A1 | 4/2012 | Rieke et al. | |
| 2016/0223198 | A1 | 8/2016 | Kowald et al. | |
| 2016/0305689 | A1 | 10/2016 | Kowald et al. | |

FOREIGN PATENT DOCUMENTS

| | | | |
|---|---|---|---|
| CN | 1930441 | A | 3/2007 |
| CN | 201203263 | Y | 3/2009 |
| EP | 0596555 | A1 | 5/1994 |
| FR | 1147639 | A | 11/1957 |
| FR | 2581735 | A1 | 11/1986 |
| JP | S5620908 | A | 2/1981 |
| JP | 2007253206 | | 10/2007 |

OTHER PUBLICATIONS

Foreign Communication From a Related Counterpart Application, Chinese Application No. 201010594963.0, First Chinese Office Action dated Jan. 30, 2014, 6 pages.
U.S. Appl. No. 15/091,956, Kowald et al.
U.S. Appl. No. 15/193,631, Kowald et al.

* cited by examiner

FURNACE, A METHOD FOR OPERATING A FURNACE AND A FURNACE CONTROLLER CONFIGURED FOR THE SAME

CROSS-REFERENCE TO RELATED APPLICATION

This patent application is a continuation application of U.S. patent application Ser. No. 15/091,956, filed on Apr. 6, 2016. U.S. patent application Ser. No. 15/091,956 is a continuation application of U.S. patent application Ser. No. 12/834,478, filed on Jul. 12, 2010. U.S. patent application Ser. No. 12/834,478 claims the benefit of U.S. Provisional Application No. 61/295,501, filed on Jan. 15, 2010. U.S. patent application Ser. No. 15/091,956, U.S. patent application Ser. No. 12/834,478, and U.S. Provisional Application No. 61/295,501 are incorporated herein by reference.

TECHNICAL FIELD

This application is directed, in general, to furnaces and, more specifically, to starting inducers of gas furnaces.

BACKGROUND

HVAC systems can be used to regulate the environment within an enclosure. Typically, an air blower is used to pull air from the enclosure into the HVAC system through ducts and push the air back into the enclosure through additional ducts after conditioning the air (e.g., heating or cooling the air). For example, a gas furnace, such as a residential gas furnace may be used to heat the air.

In a residential gas furnace, a combustion air inducer is turned-on when a heating call from a thermostat is received. The combustion air inducer is used to draw air through the heat exchangers of the gas furnace for combustion. Once combustion air flow has been established, a pressure switch is closed. The pressure switch is a critical safety feature since, if adequate air flow through the heat exchangers is not established, flames from the heat exchangers could roll-out in an unsafe manner. Once the pressure switch closes to indicate adequate air flow through the heat exchangers, the igniter energizes, the gas valve opens and a flame sensor validates the presence of a flame.

SUMMARY

In one aspect, the disclosure provides a controller for a gas furnace. In one embodiment, the controller includes: (1) an interface configured to receive a heating call and (2) a processor configured to enable an inducer of the gas furnace at a low speed based on the heating call and ignite the gas furnace at a high fire operation when determining a low fire pressure switch of the gas furnace is open.

In another aspect, a computer-usable medium is disclosed having computer readable instructions stored thereon for execution by a processor to perform a method. In one embodiment, the method includes: (1) enabling an inducer of a gas furnace at a low speed based on receipt of a heating call, (2) determining if a low fire pressure switch of the gas furnace is closed and (3) igniting the gas furnace at a high fire operation when determining the low fire pressure switch is open.

In yet another aspect, a gas furnace having a heat exchanger is disclosed. In one embodiment, the gas furnace includes: (1) an inducer configured to draw combustion air through the heat exchanger, (2) a low fire pressure switch configured to close when flow of the combustion air has been established for a low fire operation, (3) a high fire pressure switch configured to close when flow of the combustion air has been established for a high fire operation and (4) a controller configured to direct operation of the gas furnace. The controller having: (4A) an interface configured to receive a heating call and (4B) a processor configured to enable the inducer at a low speed based on the heating call and ignite the gas furnace at the high fire operation when determining the low fire pressure switch is open.

BRIEF DESCRIPTION

Reference is now made to the following descriptions taken in conjunction with the accompanying drawings, in which.

DETAILED DESCRIPTION

In furnaces with multiple heat inputs, it is often advantageous to fire at the lowest firing rate since this can provide the quietest operation. Thus, instead of starting at a high fire operation when receiving a heating call, furnaces having at least two operating stages may start at a low fire operation. Gas furnaces typically also start at low fire operation under abnormal conditions such as low voltage or low ambient temperature. The pressure switch associated with the low fire operation, a low fire pressure switch, however, may not close under these conditions. If adequate air flow is not established, this can result in a safety lock-out of the equipment that prevents the gas furnace from operating. Disclosed herein are embodiments that address safely starting a gas furnace even when the low fire pressure switch does not close. As such, the disclosure provides embodiments that can reduce the down time of a furnace and service calls from technicians.

The disclosure provides a furnace that first tries to close the low fire pressure switch and light on low fire. Unlike conventional furnaces, however, if the low fire pressure switch does not close, the furnace will then ignite (which includes attempting to ignite) on high fire. After a preset period of time (e.g., twenty seconds in one embodiment) the furnace can then switch back to low fire operation.

Figure 1:
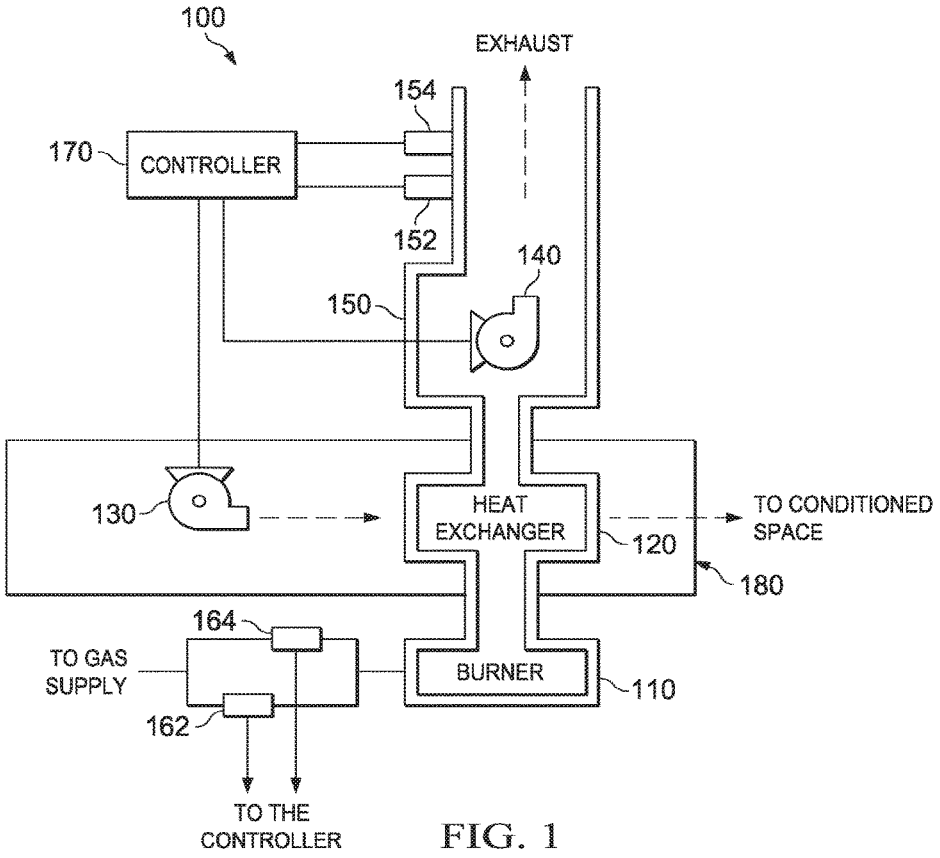
FIG. 1 is a diagram of an embodiment of a furnace constructed according to the principles of the disclosure.

FIG. 1 is a block diagram of an embodiment of a furnace 100 constructed according to the principles of the disclosure. The furnace 100 is a combustible fuel-air burning furnace, such as, a natural gas furnace or a propane furnace. The furnace 100 may be for a residence or for a commercial building (i.e., a residential or commercial unit). The furnace is configured to operate in at least two modes of operation (e.g., a low fire operation mode and a high fire operation mode).

The furnace 100 includes a burner assembly 110, a heat exchanger 120, an air circulation blower 130, an inducer 140, a low pressure switch 152, a high pressure switch 154, a low fire gas valve 162, a high fire gas valve 164 and a controller 170. Portions of the furnace may be contained within a cabinet 180. In some embodiments, the controller 170 may also be included in the cabinet 180. One skilled in the art will understand that the furnace 100 may include additional components and devices that are not presently illustrated or discussed but are typically included in a furnace. A thermostat (not shown) is also typically employed with a furnace and is used as a user interface.

The burner assembly 110 includes a plurality of burners that are configured for burning a combustible fuel-air mixture (e.g., gas-air mixture) and provide a combustion product to the heat exchanger 120. The heat exchanger 120 is configured to receive the combustion product from the burner assembly 110 and use the combustion product to heat air that is blown across the heat exchanger 120 by the air circulation blower 130. The air circulation blower 130 is configured to circulate air through the cabinet 180, whereby the circulated air is heated by the heat exchanger 120 and supplied to conditioned space. The inducer 140 is configured to supply combustion air to the burner assembly 110 by an induced draft and is also used to exhaust products of combustion from the furnace 100. The air inducer 140 is configured to at least operate at two speed settings corresponding to the modes of operation of the furnace 100. For a low fire operation mode, the inducer 140 operates at a lower speed to generate sufficient combustion air for a low fire operation. For a high fire operation mode, the inducer 140 operates at a higher speed to generate sufficient combustion air for a high fire operation.

The low pressure switch 152 and the high pressure switch 154 measure combustion air pressure on the discharge side of the inducer 140. Low pressure switch 152 is configured to indicate when combustion air pressure is sufficient to support a low fire operation of the furnace 100. Similarly, high pressure switch 154 is configured to indicate when combustion air pressure is sufficient to support a high fire operation of the furnace 100. In the disclosed embodiment, the low pressure switch 152 and the high pressure switch 154 are closed when combustion air pressure is sufficient for a low fire operation or a high fire operation, respectively. Accordingly, when the low pressure switch 152 is open, this indicates that there is insufficient combustion air to support even a low fire operation. When the high pressure switch 154 is open, this indicates that there is insufficient combustion air to support a high fire operation.

As noted above, the furnace 100 is a multi-stage or variable input furnace operable in at least two modes of operation, such as, low fire and high fire modes. With two stages or two modes of operation, the furnace 100 may also include the low fire gas valve 162 and the high fire gas valve 164. In low fire operation, only the low fire gas valve 162 is open to supply fuel to burner assembly 110. In high fire operation, both the low fire gas valve 162 and the high fire gas valve 164 are open to supply more fuel to burner assembly 110.

The controller 170 is configured to control the operation of the furnace 100. A burner control board and an air blower control board may also be included in the furnace 100 to control operation of the low fire gas valve 162, the high fire gas valve 164 and the air blower 130, respectively. As such, the controller 170 would cooperate with the burner control board and the air blower control board to direct operation of the furnace 100.

The controller 170 may include a processor, such as a microprocessor, configured to direct the operation of the furnace 100. Additionally, the controller 170 may include a memory section. The memory section may be a conventional memory. The memory section may include a series of operating instructions that direct the operation of the controller 170 (e.g., the processor) when initiated thereby. The series of operating instructions may represent algorithms that are used to manage operation of the furnace 100 including interpreting air pressure data, igniting the burner assembly 110 and controlling the speed of the air blower 140.

Figure 2:
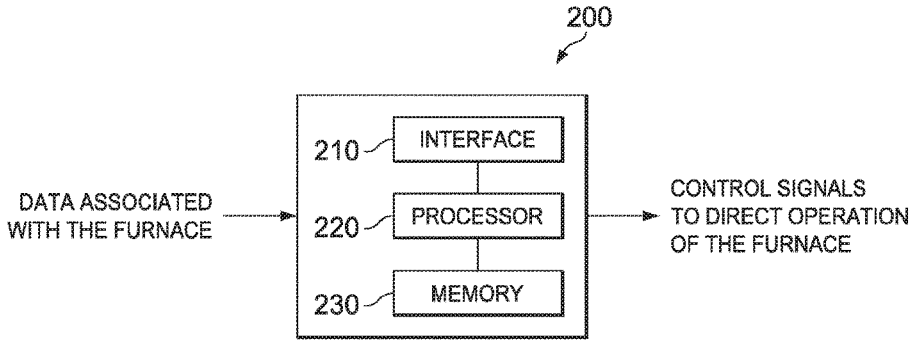
FIG. 2 is a block diagram of an embodiment of controller of a furnace constructed according to the principles of the disclosure.

The controller 170 is configured to enable the inducer 140 at a low speed based on a heating call and ignite the gas furnace at a high fire operation when determining the low fire pressure switch is open. Thus, unlike conventional furnaces, the controller 170 is configured to operate the furnace 100 even when the low fire pressure switch 162 has not closed. The controller 170 may include an interface to receive the heating call and a processor to direct the operation of the furnace 100 as described above. FIG. 2 illustrates an embodiment of a controller 200 that may be used with the furnace 100.

As illustrated in FIG. 1, the controller 170 is coupled to the various components of the furnace 100. In some embodiments, the connections therebetween are through a wired-connection. A conventional cable and contacts may be used to couple the controller 170 to the various components of the furnace 100. In some embodiments, a wireless connection may also be employed to provide at least some of the connections.

FIG. 2 is a block diagram of an embodiment of the controller 200 of a furnace constructed according to the principles of the disclosure. The controller 200 includes an interface 210, a processor 220 and a memory 230.

The interface 210 is configured to receive signals for and transmit signals from the controller 200. The interface 210 may be a conventional interface having input and output ports for communicating. The input and output ports may be configured for wireless or wired communications.

The processor 220 may be a conventional processor. In some embodiments, the processor may be a microprocessor. The processor 220 is configured to enable the inducer of a furnace at a low speed based on a heating call and ignite the gas furnace at a high fire operation when determining the low fire pressure switch of the furnace is open. In one embodiment, when the processor 220 determines the low fire pressure switch is open, the processor 220 is configured to automatically ignite the gas furnace at a high fire operation. Additionally, the processor 220 is configured to switch the inducer to operate at a high speed when determining the low fire pressure switch is open. After the inducer is switched to operate at high speed, the processor 220 is configured to determine if the low fire pressure switch is closed and if the high fire pressure switch is closed. When determining the low fire pressure switch and the high fire pressure switch are closed, the processor 220 is configured to ignite the gas furnace at the high fire operation. If the processor 220 determines either the low fire pressure switch or the high fire pressure switch is open, the processor 220 is configured to initiate a lockout routine. The processor 220 may be configured to operate the gas furnace at the high fire operation for a preset period of time. The amount of time may vary per furnace installation, furnace model or preferences. In one embodiment, the present period of time is twenty seconds.

The memory 230 may be a conventional memory. The memory 230 may include a series of operating instructions that direct the operation of the processor 220 when initiated thereby. The series of operating instructions may represent algorithms that are used to manage operation of a furnace such as the furnace 100 of FIG. 1.

Figure 3:
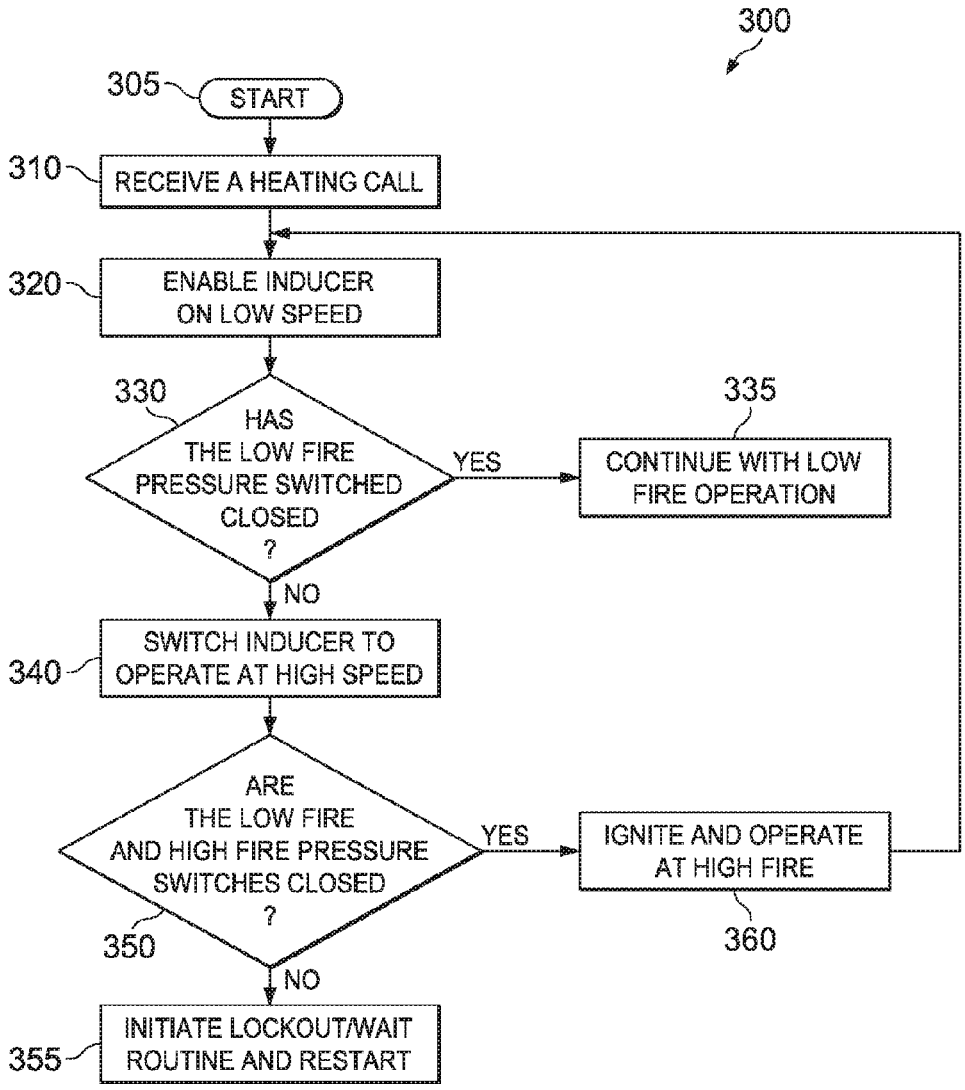
FIG. 3 is a flow diagram of an embodiment of a method of operating a furnace carried out according to the principles of the disclosure.

FIG. 3 is a flow diagram of an embodiment of a method 300 of operating a furnace carried out according to the principles of the disclosure. The controller 170 of FIG. 1 or the controller 200 of FIG. 2 may be used to perform the method 300. The method 300 includes igniting the gas furnace at a high fire operation when determining the low fire pressure switch is open. Thus, even when a heating call may be for a low fire operation, the method 300 can still ignite the furnace at a high fire operation. The method 300 begins in a step 305.

In a step 310, a heating call for the furnace is received. The heating call may be received from a thermostat associated with the furnace.

In a step 320, an inducer of the gas furnace is enabled at a low speed based on receipt of the heating call. The inducer may be configured to at least operate at a high speed and a low speed. In some embodiments, the furnace may initially start the inducer at low speed to correspond to a low fire operation of the furnace.

A determination is then made in a first decisional step 330 if a low fire pressure switch of the gas furnace is closed. If the low fire pressure switch is open (i.e., not closed), the inducer is switched to operate at a high speed in a step 340.

A determination is then made in a second decisional step 350 if the low fire pressure switch is closed and if the high fire pressure switch is closed after switching the inducer to operate at the high speed. If so, the gas furnace is ignited at a high fire operation in a step 360. In one embodiment, the furnace is operated at high fire operation for a preset period of time. The method 300 then returns to step 320 and continues.

Returning now to the first decisional step 330, if the low fire pressure switch has closed, the method 300 continues to step 335 and ends. In step 335, the furnace continues with a low fire operation. Returning now to decisional step 350, if either the high fire pressure switch or the low fire pressure switch are open, the method 300 continues to step 355 where a lockout/wait and restart routine is initiated.

Those skilled in the art to which this application relates will appreciate that other and further additions, deletions, substitutions and modifications may be made to the described embodiments.

The invention claimed is:

1. A gas furnace comprising:

a controller configured to operate the gas furnace, the controller comprising:

an interface configured to receive a heating call for a low fire operation of the gas furnace; and a processor configured to perform following steps, wherein each step directly follows the next step:

enable an inducer of the gas furnace to operate at a low speed in response to receiving the heating call;

determine whether a low fire pressure switch of the gas furnace is open;

responsive to the determination that the low fire pressure switch is open, switch the inducer to operate at a high speed;

determine whether the low fire pressure switch and a high fire pressure switch are closed; and responsive to the determination that the low fire pressure switch and the high fire pressure switch are closed, ignite the gas furnace at a high fire operation.

2. The gas furnace of claim 1, further comprising:

a heat exchanger; and wherein the inducer is configured to draw combustion air through the heat exchanger.

3. The gas furnace of claim 2, wherein:

the low fire pressure switch is configured to close when flow of the combustion air has been established for the low fire operation; and the high fire pressure switch is configured to close when flow of the combustion air has been established for the high fire operation.

4. The gas furnace of claim 1, wherein the processor is configured to operate the gas furnace at the high fire operation for a preset period of time.

5. The gas furnace of claim 1, wherein the processor is configured to:

responsive to the determination that the low fire pressure switch is open, ignite the gas furnace at the high fire operation.

6. The gas furnace of claim 1, wherein the processor is configured to:

responsive to the determination that the low fire pressure switch is open, initiate a lockout routine.

7. The gas furnace of claim 1, wherein the processor is configured to:

responsive to the determination that the high fire pressure switch is open, initiate a lockout routine.

8. The gas furnace of claim 1, wherein the processor is configured to:

responsive to the determination that either the low fire pressure switch or the high fire pressure switch is open, initiate a restart routine.

9. The gas furnace of claim 1, wherein the low fire pressure switch and the high fire pressure switch are configured to measure combustion air pressure on a discharge side of the inducer.

10. The gas furnace of claim 9, wherein the low fire pressure switch is configured to indicate when the combustion air pressure supports the low fire operation of the gas furnace.

11. The gas furnace of claim 9, wherein the high fire pressure switch is configured to indicate when the combustion air pressure supports the high fire operation of the gas furnace.

12. A controller for a gas furnace, the controller comprising:

a processor configured to perform following steps, wherein each step directly follows the next step:

enable an inducer of the gas furnace to operate at a low speed in response to receiving a heating call for a low fire operation;

determine whether a low fire pressure switch of the gas furnace is open;

responsive to the determination that the low fire pressure switch is open, switch the inducer to operate at a high speed;

determine whether the low fire pressure switch and a high fire pressure switch are closed; and responsive to the determination that the low fire pressure switch and the high fire pressure switch are closed, automatically ignite the gas furnace at a high fire operation.

13. The controller of claim 12, wherein the processor is configured to operate the gas furnace at the high fire operation for a preset period of time.

14. The controller of claim 12, wherein the processor is configured to:

responsive to the determination that the low fire pressure switch is open, ignite the gas furnace at the high fire operation.

15. The controller of claim 12, wherein the processor is configured to:

responsive to the determination that the low fire pressure switch is open, initiate a lockout routine.

16. The controller of claim 12, wherein the processor is configured to:

responsive to the determination that the high fire pressure switch is open, initiate a lockout routine.

17. The controller of claim 12, wherein the processor is configured to:

responsive to the determination that either the low fire pressure switch or the high fire pressure switch is open, initiate a restart routine.

18. A method of operating a gas furnace, the method comprising performing following steps, wherein each step directly follows the next step:

receiving a heating call for a low fire operation of the gas furnace;

enabling, using a processor, an inducer of the gas furnace to operate at a low speed in response to receiving the heating call;

determining, using the processor, whether a low fire pressure switch of the gas furnace is open;

responsive to the determination that the low fire pressure switch is open, switching the inducer to operate at a high speed;

determining, using the processor, whether the low fire pressure switch and a high fire pressure switch are closed; and responsive to the determination that the low fire pressure switch and the high fire pressure switch are closed, igniting the gas furnace at a high fire operation; and responsive to the determination that either the low fire pressure switch or the high fire pressure switch is open, initiating, using the processor, a restart routine.

19. The method of claim 18, wherein the processor is configured to operate the gas furnace at the high fire operation for a preset period of time.

20. The method of claim 18, wherein the low fire pressure switch and the high fire pressure switch are configured to measure combustion air pressure on a discharge side of the inducer.

* * * * *